United States Patent [19]

Gatti

[11] Patent Number: 4,919,071

[45] Date of Patent: Apr. 24, 1990

[54] DRY TONER REMOVABLE DEVELOPING CARTRIDGE

[75] Inventor: Giancarlo Gatti, Varese, Italy

[73] Assignee: Bull HN Information Systems Italia S.p.A., Caluso, Italy

[21] Appl. No.: 250,475

[22] Filed: Sep. 28, 1988

[30] Foreign Application Priority Data

Nov. 5, 1987 [IT] Italy ..... 22525

[51] Int. Cl.[5] ..... G03G 15/08

[52] U.S. Cl. ..... 118/653; 222/DIG. 1; 222/368; 355/245

[58] Field of Search ..... 118/653–658; 222/368, DIG. 1; 355/245, 251–253, 259

[56] References Cited

U.S. PATENT DOCUMENTS 3,764,208 10/1973 Takahashi ..... 355/253
4,349,132 9/1982 Macaluso ..... 222/DIG. 1
4,692,018 9/1987 Tamura ..... 355/245

*Primary Examiner*—R. L. Moses

*Attorney, Agent, or Firm*—John S. Solakian; Gerald J. Cechony

[57] ABSTRACT

Dry toner removable developing cartridge of the disposable type, for electrophotographic printers, comprising a photoconductive drum, a donor sleeve contacting the photoconductive drum and partially housed in a developing tank having a stirrer for the developing material contained therein, the donor sleeve conveying to the photoconductive drum a predetermined amount of developing material, and a cylindrical reservoir, in communication with the development tank through a peripheral arc and containing radial diaphragms supported by a rotatable control shaft, which diaphragms define in the cylindrical reservoir a plurality of compartments in form of cylindrical sectors, filled with developing material, the sectors being sequentially brought into communication with the developing tank by rotation of the shaft and sequentially feeding the developing tank with developing material dropped from the compartments.

6 Claims, 3 Drawing Sheets

DRY TONER REMOVABLE DEVELOPING CARTRIDGE

The present invention relates to a dry toner removable developing cartridge, of the disposable type, for electrophotographic printers.

Electrophotographic printers and copying machines have been recently put on the market, where all the elements subject to deterioration and consumption are grouped in a removable cartridge which is periodically replaced with a new one, in a manner designed to be convenient for the user.

This is done for the purpose of minimizing or completely avoiding maintenance operations.

Among the consumable elements of an electrophotographic printer, the photo sensitive member and the developing material or toner must be expressely mentioned.

The developing material, contained in a developing device housing has a very short life, far less than the photosensitive member, (usually a drum), and limits the useful life of the disposable cartridges of this type, if it is not periodically augmented with new added material.

Whilst in the past this operation was performed by the user, who had to pour the developer in the developing housing from separate containers, there is an emergent trend to provide developing units with one, or in the case of two component-developers with two, reserve containers, which can drop their contents into the developing housing by a simple operation.

Even this solution of the problem is limited, in that the volume of the developing material contained in the reserve container cannot exceed the volume of the developer housing, which in turn is limited by the following factors:

Within the developer housing a stirrer is mounted which has the purpose of providing a uniform developer distribution and of mixing it, inducing an electrostatic charge on the developer by triboelectric effect.

However this stirring, together with the conveyance function performed by a developing sleeve, has the effect of aging the developing material, modifying its properties, among which are the ability to electrostatically charge and retain such charge.

Therefore it is of advantage to have a minimum quantity of developing material in the developing housing.

A further constraint is due to the fact that if the developing material exceeds a certain volume, its own weight tends to compact it with consequent forming of lumps which are difficult for the stirrer to break up and which cause greater stirring work.

Therefore very complex feeding systems for the developing material have been proposed, which supply the developing material from a reservoir, gradually and in continuous way, through feeding screws or controlled hoppers.

An example of these systems and related cartridge is described in the european patent application published with N. 0225117 which relates in particular to a developing cartridge wherein a two component developing material, respectively the "carrier" and the "toner" are contained in two reservoirs and continuously feed a developing housing, with a feeding rate which changes depending on the aging of the residual developing material contained in the developing housing.

Solutions of this kind, however effective, are expensive and in conflict with the market requirement of having disposable developing units with a useful life commensurate with the useful life of the photosensitive member, but at the same time inexpensive.

This limitation is overcome by the removable developing cartridge of the present invention, which is simple and inexpensive and which minimizes the aging of the developing material providing at the same time an operative life of the cartridge adjusted to the useful life of the photoconductive drum.

Additionally, in case of two-component developing material, it allows to change the carrier concentration relative to that of the toner, so as to assure an optimum printing quality for the whole useful life of the cartridge.

These advantages are achieved with the adoption of a cylindrically shaped reservoir, which communicates with the developing housing along a peripheral arc and which is provided with radial diaphragms fixed to a central shaft, coaxial to the cylindrical reservoir and rotatably mounted thereto.

The diaphragms define, within the reservoir, a plurality of housings in form of cylindrical sectors, wherein the developer material is contained.

By rotation of the shaft the developer material is poured in the developing housing.

These and other features of the invention and its advantages will appear more clearly from the following description of a preferred form of embodiment of the invention and from the enclosed drawings where:

FIG. 1 is a section view of the removable developing cartridge of the invention.

Figure 1:
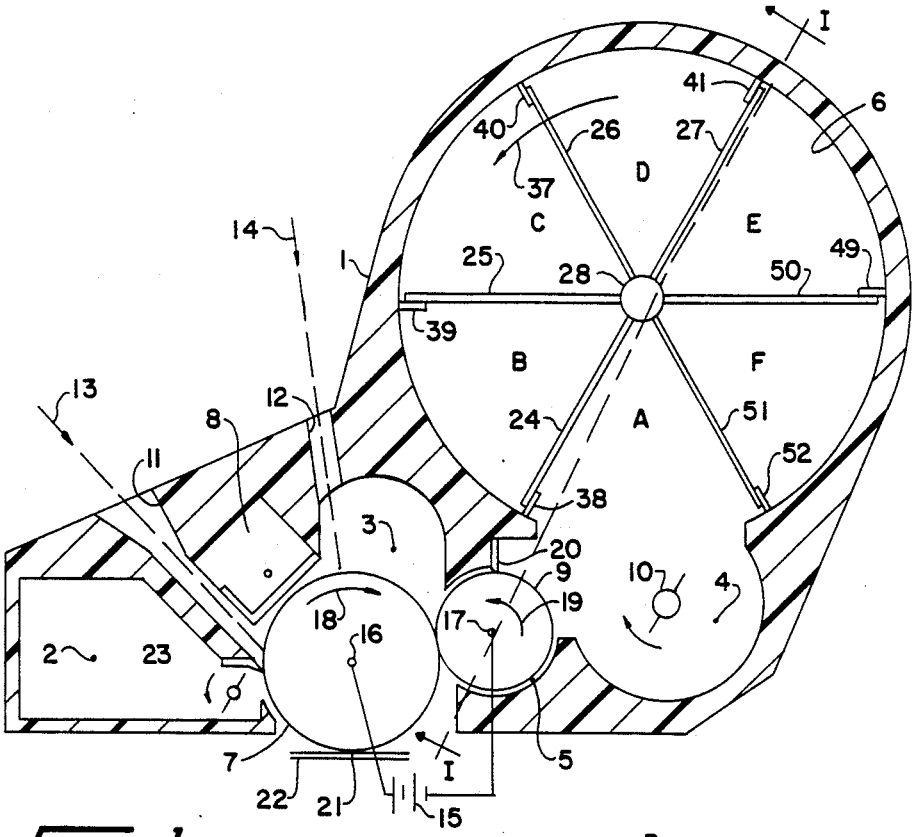
FIG. 1 is a sectional view of the removable developing cartridge of the invention.

The cartridge is formed by a plastic body 1 which defines five inner spaces or housings 2,3,4,5,6, the first four housings being located, relative to each other in known manner to form a collecting reservoir 2 for residual toner, a housing 3 for a photosensitive drum 7 and a corona discharge unit 8, a housing 5 for a donor or developer sleeve 9, and a developing tank 4, where a rotating stirrer 10 is located.

The cartridge has two slots 11,12 through which a normalization light beam 13 and a scanning latent image forming light beam 14 are directed on the photosensitive drum 7.

A voltage source, external to the cartridge and having terminals 16,17 respectively connected to the photosensitive drum and to the developer sleeve, provides a suitable electrical biasing of the two elements.

The operation of these devices is known: the photosensitive drum rotates in the direction indicated by arrow 18 and its surface is uniformly charged by device 8 with an electrostatic charge.

The scanning light beam 14, modulated by a write command (or by an image to be copied in case of a copying machines) causes the local erasing of the electrostatic charge on the photosensitive drum, in all those points which are exposed to the light, and the generation of a latent electrostatic image having an electrical potential other than the one of the unexposed areas.

The donor sleeve, which rotates in the direction of arrow 19 with the same peripheral speed of drum 7, bears on its surface a uniform layer of developing material, collected from the developing tank.

A doctor blade 20 assures that the layer thickness does not exceed a predetermined amount.

The photosensitive drum 7 and the sleeve 9 contact each other along a generatrix.

Along this generatrix the developing material present on the donor sleeve is transferred to the photosensitive drum, but only in those points where a difference in potential exists between the latent image areas and the toner on the sleeve.

This difference in potential is caused by voltage source 15.

In all other points the developing material is retained on the donor sleeve and returned to the developing tank.

The photosensitive drum contacts a printing support 22, normally a paper sheet, along a second generatrix and transfers the developing material to the printing support.

The toner is then fixed to the printing support in a fusing station, not shown.

The possible residual toner, which is not transferred to the printing support, is removed from the photosensitive drum by a scraping knife 23 and collected in reservoir 2.

The light beam 13, directed on drum 7, neutralizes possible residual electrostatic charges and generator 8 recharges drum 7 with uniformly distributed electrostatic charges.

Thereafter, the described operative cycle is repeated.

In order to obtain good quality images on the printing support, in a continuous and repetitive way for the whole life of the photosensitive drum, it is mandatory to assure the presence of fresh developing material, in relatively constant quantity, within the developing tank.

If the quantity of developing material is less than a predetermined amount, stirrer 10 is unable to provide a stirring of the material sufficient to induce therein an adequate triboelectric charge which assure the retention of the developing material on the developing sleeve.

Further the stirrer 10 is unable to cause a uniform distribution of the developing material in the developing tank.

As a consequence a layer of developing material which has a thickness less than the one imposed by doctor blade 20 or uneven distribution is formed on the donor sleeve.

The insufficient amount of developing material forms faded images on the printing support or images having zones of differing strength.

On the other hand an excessive amount of developing material in the developing tank 4 causes compaction and lump formation.

Eventually similar effects shows as in the case of insufficient toner.

In order to avoid this inconvenience it is necessary to periodically feed the developing tank 4 with a suitable amount of new developing material.

The cartridge of the present invention performs this function in very simple and inexpensive way.

As it can be seen in FIG. 1, cartridge 1 forms a cylindrical housing 6 just above developing tank 4.

Housing 6 has a volume much greater than the one of tank 4, for instance 4 to 10 times greater.

Housing 6 communicates with tank 4 along a peripheral arc and constitutes a developing material reservoir.

It is divided into a plurality of compartments A,B,C,D,E,F by a plurality of radial diaphragms 24,25,26,27,50,51, fixed to a central shaft 28, coincident with the central axis of the cylindrical housing and rotatable therein.

The several compartments have the form of cylindrical sectors, subtended by an arc having a width slightly greater than the peripheral communication arc of housing 6.

For a predetermined angular position of shaft 28 and associated diaphragms, only one compartment, for instance compartment A, is in communication with developing tank 4.

By rotation of shaft 28 and associated diaphragms in the direction indicated by arrow 37, the several compartments B,C,D,E,F, are brought sequentially in communication with developing tank 4.

The several compartments, with exception of compartment A, may be filled with developing material, which is therefore sequentially dropped within developing tank 4 and provides for its replenishment a first time when the cartridge is installed and subsequently when need for replenishment arises.

If N is the number of compartments, the replenishment may be performed. N-1 times, or N times with suitable modification to the cartridge.

Figure 2:
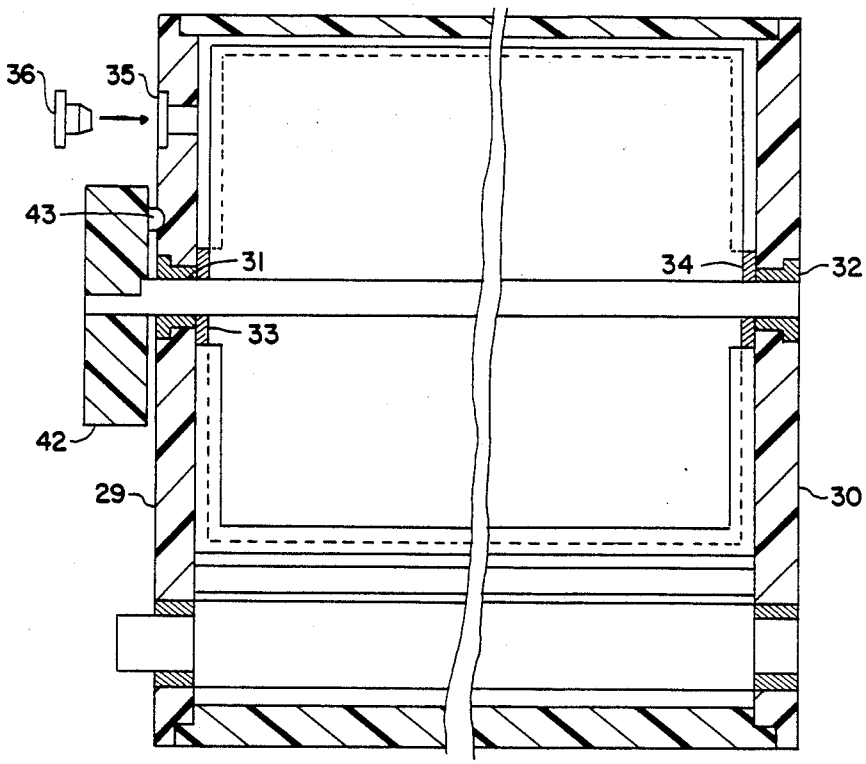
FIG. 2 is a transverse sectional view of the cartridge of FIG. 1.

FIG. 2 is a section view of cartridge 1 according to the section indicated by I—I in FIG. 1.

As shown in FIG. 2, cartridge 1 is closed by two parallel side plates 29,30 of plastic, each provided with a bushing 31,32 for pivoting of shaft 28.

Two felt gaskets prevent leakage of developing material through the bushings.

Likewise sliding blocks 38,39,40,41,42 of felt or other suitable material (FIG. 1) located at the edges of the several diaphragms 25,26,27,28,50,51 provide the sealing of the developing material in the several compartments.

One of the side plates 29, has at least one opening 35, closed by a plastic plug.

Through such opening, the several compartments, less one, may be filled in sequence, with developing material.

Shaft 28 protrudes outside of side plate 29, with a post, onto which a mechanical transmission member (gear, Geneva member or the like,) can be mounted to provide shaft and related compartments rotation by motor means, not shown.

Rotation of the shaft may be performed under control of suitable detectors which detect an insufficient volume of developer in the developing tank.

Preferably, as shown in FIG. 2, a plastic knob 43 is splined on the shaft post and rotation is manually performed.

Knob 42 cooperates with a plurality of recesses, radially distributed around bushing 33, to provide relatively stable angular position to knob 42, to shaft 28 and related diaphragms.

Knob 42 may be further provided with a reference angular pointer and the side plate 29 may have a sequence of angular position marks, radially distributed around gasket 31, each referenced by a progressive number in relief or recess over the external surface of side plate 29.

Figure 3:
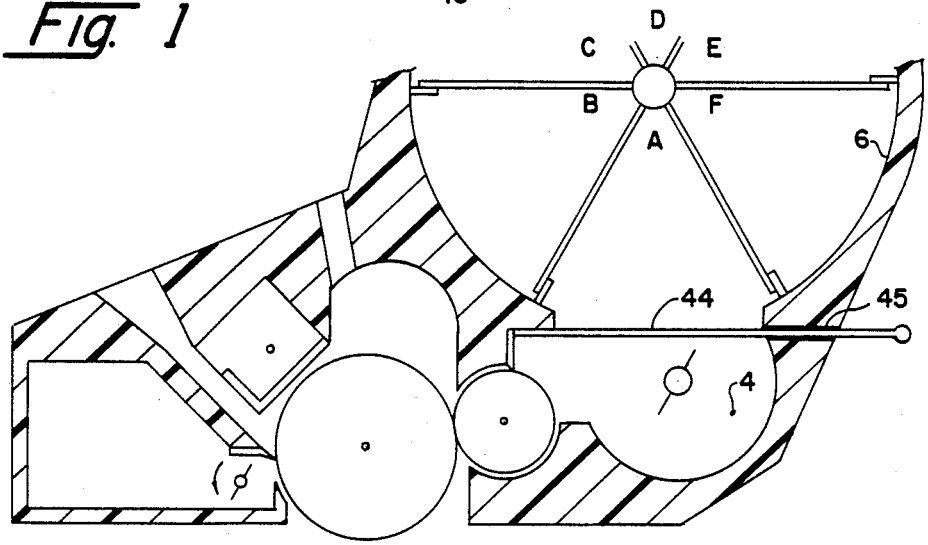
FIG. 3 is a sectional view of a modification in the cartridge of FIG. 1.

FIG. 3 is a sectional view of an alternative embodiment of the invention cartridge, which allows for the loading with developing materials of all the compartments formed by the diaphragms.

The cartridge of FIG. 3 differs from the one of FIG. 1 in one detail only. Therefore reference numbers for referencing identical elements are omitted, except those few required for a better understanding.

In FIG. 3, housing 6 is separated from tank 4 by a thin diaphragm 44 inserted in the cartridge body 1 through a slot 45, during the manufacturing process and before the several compartments B,C,D,E,F are filled with developing material.

Diaphragm 44 has the function of temporarily closing compartment A and of dividing it from tank 4, so that compartment A may be filled with developing material during the manufacturing process of the cartridge.

When cartridge 1 is inserted in a printer for use, diaphragm 44 may be withdrawn from its seat so that developing material contained in compartment A is dropped in developing tank 4.

Once the developing material in tank 4 is exhausted, tank 4 may be replenished by rotation of shaft 28 so that compartment B is located above tank 4, and so on for the subsequent compartments from C to F.

In this way the volume of housing 6 may be fully exploited for the storage of developing material, and removable cartridges having long life and reduced bulk can be designed.

Figure 4:
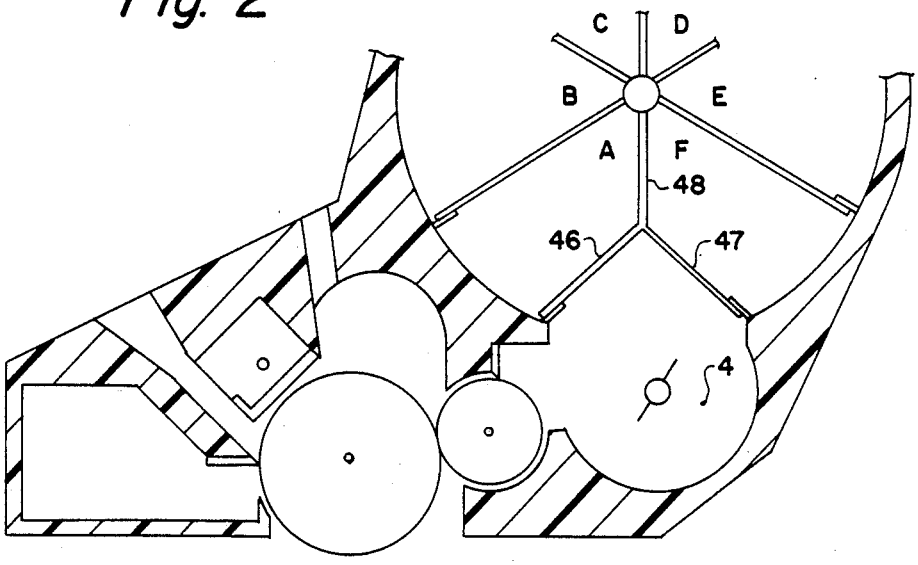
FIG. 4 is a sectional view of a further modification in the cartridge FIG. 1.

The same result achieved with the arrangement of FIG. 3 may be achieved with the arrangement of FIG. 4.

In FIG. 4, one of the radial diaphragms, fixed to shaft 28, and referenced by numeral 48, opens itself in two wings 46,47, which, when diaphragm 45 is located in median position as to the communication sector between housing 6 and tank 4, completely close such passageway.

In this way housing 6 may be divided by radial diaphrams in several compartments, for instance six, as shown in FIG. 4, and all the compartments may be filled with developing material.

By rotating shaft 28 counterclockwise, for an angle of 30 deg. compartment A may be brought in communication with developing tank 4, to drop therein developing material.

By subsequent rotations of the shaft 28 for 60 deg. the subsequent compartments B,C,D,E,F may be brought in communication with tank 4.

As already mentioned it is clear that the number of compartments, as well as the size of housing 6 relative to the capacity of developing tank 4 may be selected within very broad limits.

Cartridges as the one shown in FIGS. 1 or 3 or 4, provide, in addition to the already mentioned advantages a further and relevant one.

It is known that in case of two-component developing material, comprising a carrier and a toner, the carrier, generally in lesser percentage as to the toner, plays an essential role in the transport of the toner from the developing housing to the photosensitive drum.

The carrier is consumed much less than the toner, because it operates as mediator, but in the course of operation, it tends to age and to wear.

A cartridge like the one shown has the advantage that in each compartment A,B,C,D,E,F, an amount of developing material may be stored, in which the ratio (in volume or weight) between carrier and toner, is variable from compartment to compartment so as to stay commensurate with the effective requirements.

Thus, with reference to FIG. 1, compartment B may be loaded with developing material where the carrier is 20% of the developing material. This ratio may be indicated for explanatory purpose, as the best one for starting operation of the cartridge.

When the contents of compartment B is dropped in the developing housing and the cartridge is put in service, the toner is consumed much more than the carrier, and the carrier concentration increases.

Assuming for example minimum quantity of developing material in developing tank required for operation of the cartridge is 20% of the original one and the carrier consumption is 50% of the original one, the final carrier concentration will be 50% of the residual developing material.

Compartment C, intended for replenishment of the developing tank, will therefore contain developing material in which the carrier concentration is only 10%, or sightly more, so as to bring the carrier concentration to the original level of 20% or slightly more.

Compartment D, intended for replenishing the development tank a second time, will contain developing material in which the carrier concentration is 13%, not only to replenish the exhausted carrier, but also to compensate for the aging of the residual carrier in the development housing.

Likewise, in order to compensate for such a progressive aging of the carrier, compartments D,E,F may be filled with developing material having a more and more increased carrier concentration.

It is clear that the mentioned concentrations are merely indicative, since they largely depend on the composition of the developing material.

Figure 5:
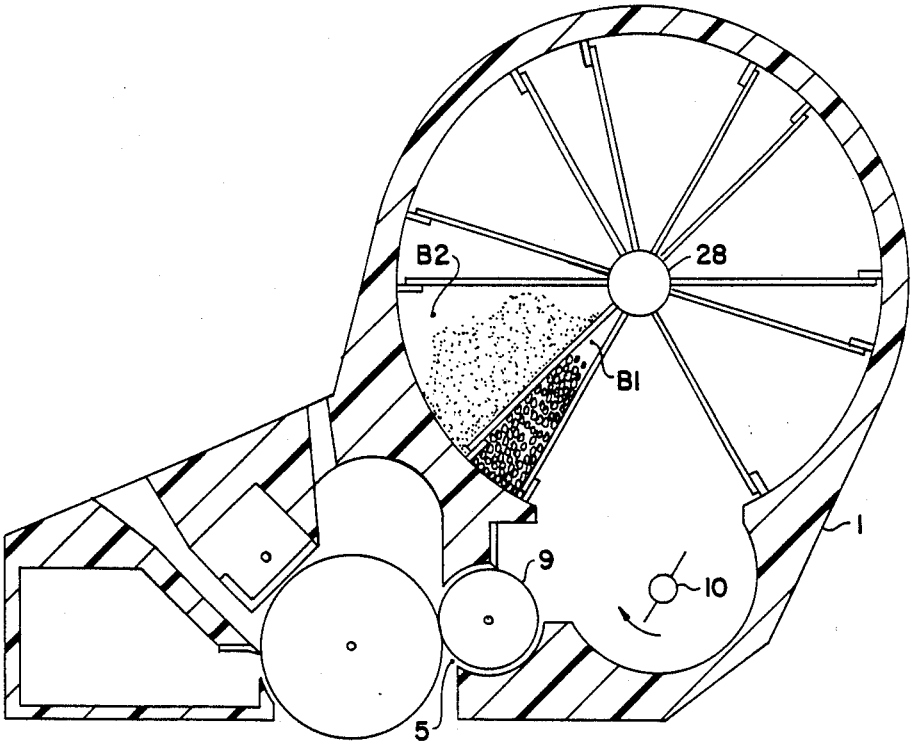
FIG. 5 is a sectional view of the cartridge of FIG. 1 loaded with two-component developing material, the two components being stored in different housings.
Figure 6:
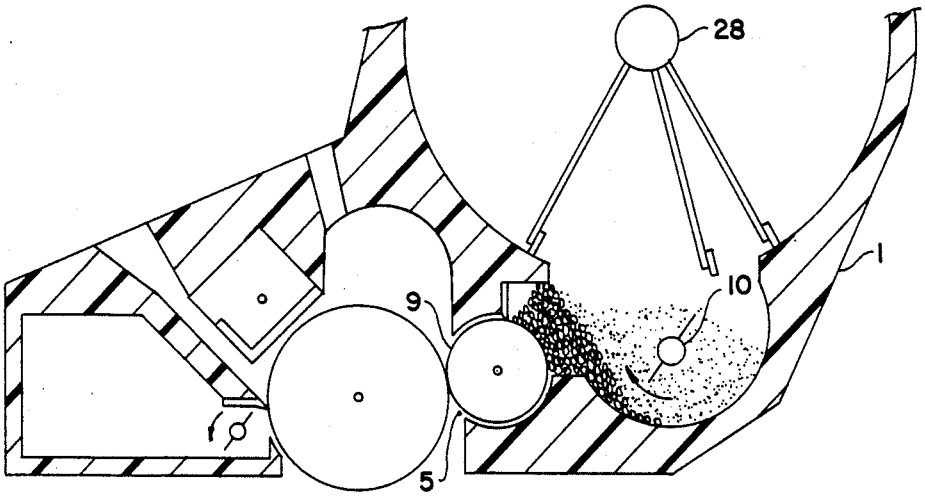
FIG. 6 is a sectional view of the cartridge of FIG. 5, with the two component developing material poured in the developing housing.

FIGS. 5,6 show a further variant of the cartridge of FIG. 1.

In some printers, which make use of two components developers, it is of essence, as shown by U.S. Pat. No. 4,606,990, that the carrier be dropped in the developing tank, mostly in the proximity of the donor sleeve 9.

This may be easily accomplished by using separate compartments formed in reservoir 6, for separately storing suitable amounts of carrier and toner.

In FIG. 5, each compartment such as B,C,D,E,F, of FIG. 1, is further divided in two compartments by an additional diaphragm.

A first compartment B1 is filled with carrier and the subsequent compartment B2 is filled (in the due ratio) with toner.

By rotation of the shaft 28 counterclockwise, the two compartments drop their contents in developing tank 4.

It is however clear, as shown in FIG. 6, that compartment B1 drops it contents into tank 4 before compartment B2 drops the toner.

Therefore the carrier tends to accumulate in proximity of the donor sleeve 9, whilst toner tends to accumulate in the residual space around stirrer 10.

It is clear that the several compartments need not have the same volume; instead, as shown in FIGS. 5,6 they may have different volumes to provide replenishment with the due ratio between components and to exploit at the same time the full volume offered by housing 6.

What is claimed is:

1. Dry toner removable developing cartridge of the type comprising a donor sleeve, and a developing tank, further comprising:

a cylindrical housing located above said developing tank and communicating with it along a peripheral arc, an axial shaft rotatably mounted in said housing, a plurality of diaphragms attached to said shaft and radially arranged in said housing around said shaft to form a plurality of compartments in form of cylindrical sectors, at least one sealed opening for filling at least some of said compartments with developing material and means to impart to said shaft and said diaphragms a rotation of predetermined angular increments so as to dispence in sequence the developing material contained in said compartments into said developing tank, one of said radially arranged diaphragms forming a pair of wings which, for a predetermined angular position of said diaphragm, close the peripheral communication arc between said cylindrical housing and said development tank, so as to permit the filling of all said compartments through said opening, with developing material.

2. Removable developing cartridge as claimed in claim 1 wherein each of said compartments is filled with a mixture of a two-component developing material having a ratio of the two components differing from compartment to compartment.

3. Removable developing cartridge as claimed in claim 1 wherein said compartments are alternatively filled in angular compartment succession with a first and a second component of a two-component developing material.

4. Removable developing cartridge as claimed in claim 3 wherein the ratio of the components contained in each pair of subsequent compartments differs from pair to pair of subsequent compartments.

5. Dry toner removable developing cartridge of the type comprising a donor sleeve, and a developing tank, further comprising:

a cylindrical housing located above said developing tank and communicating with it along a peripheral arc, an axial shaft rotatably mounted in said housing, a first plurality of diaphragms attached to said shaft and radially arranged in said housing around said shaft to form a plurality of compartments in form of cylindrical sectors, at least one sealed opening for filing at least some of said compartments with developing material and means to impart to said shaft and said diaphragms a rotation of predetermined angular increments so as to dispense in sequence the developing material contained in said compartments into said developing tank, wherein each of said compartments is filled with a two component developing material having a ratio of the two components differing from compartment to compartment.

6. Removable developing cartridge as claimed in claim 5 wherein a second plurality of diaphragms fixed to said shaft and radially arranged in said housing around said shaft divide said compartments each in a pair of sub compartments said sub compartments being alternatively filled in angular compartment succession, with a first and a second component of a two component developing material.

* * * * *